United States Patent [19]

Ashby

[11] Patent Number: 5,062,570

[45] Date of Patent: Nov. 5, 1991

[54] MAILER WITH DIE CUT INSERT AND SELF-IMAGING AREA

[75] Inventor: Robert E. Ashby, Quakertown, Pa.

[73] Assignee: Moore Business Forms, Inc., Grand Island, N.Y.

[21] Appl. No.: 615,167

[22] Filed: Nov. 19, 1990

[51] Int. Cl.[5] ..... B65D 27/04; B65D 27/34

[52] U.S. Cl. ..... 229/71; 229/69; 283/58; 462/6; 462/64

[58] Field of Search ..... 229/69, 92.3, 71; 283/58; 462/6, 2, 3, 64, 65

[56] References Cited

U.S. PATENT DOCUMENTS

| | | | |
|---|---|---|---|
| 1,424,837 | 8/1922 | Lover | 229/92.3 |
| 1,946,751 | 2/1934 | McCarthy | 229/92.3 |
| 2,831,707 | 4/1958 | James, Jr. et al. | 229/92.3 |
| 2,985,464 | 5/1961 | McFarland | 229/92.3 |
| 3,937,492 | 2/1976 | Biron | 229/92.3 |
| 4,239,114 | 12/1980 | Denay | 206/610 |
| 4,342,472 | 8/1982 | Heimann et al. | 282/11.5 |
| 4,384,670 | 5/1983 | Dicker | 229/69 |
| 4,418,865 | 12/1983 | Bowen | 229/69 |
| B1 4,425,386 | 3/1988 | Chang | 427/256 |
| 4,585,160 | 4/1986 | Fiske, II | 229/92.3 |
| 4,682,793 | 7/1987 | Walz | 282/11.5 |
| 4,705,298 | 11/1987 | Van Malderghem et al. | 282/11.5 |
| 4,729,506 | 3/1988 | Neubauer | 229/69 |
| 4,844,329 | 7/1989 | Dicker | 229/69 |

FOREIGN PATENT DOCUMENTS 2337625 7/1976 France .

*Primary Examiner*—Stephen P. Garbe

*Attorney, Agent, or Firm*—Nixon & Vanderhye

[57] ABSTRACT

A business form (mailer) has top and bottom plies that are slightly larger than an insert ply. The insert ply is connected to the top and bottom plies along one lengthwise and one widthwise edge, but is free of connection at the other lengthwise and widthwise edges. Perforations in the insert ply parallel to the connected lengthwise and widthwise edges form a detachable portion, particularly a check. A check may be made of bond paper yet information printed on the check stub (between a lengthwise edge and perforation parallel to it) is transferred to the lower ply by a self-imaging spot disposed on the top surface of the bottom ply underneath the check stub.

22 Claims, 3 Drawing Sheets

MAILER WITH DIE CUT INSERT AND SELF-IMAGING AREA

BACKGROUND AND SUMMARY OF THE INVENTION

In the production of mailer type business forms, it is often desirable to allow information printed on one part of the form to be transferred to another part of the form. This is typically done utilizing MCP paper. However, there are some circumstances when it undesirable to utilize MCP paper, such as if one part of the form is a negotiable bank check (hereafter referred to as a "check" in the specification and claims). When one of the parts is a check, it is also highly desirable to take every precaution to insure that the check will not be torn when opening the mailer, and to insure that the form feeds properly through a printer.

According to the present invention, a mailer type business form is provided which has the desirable attributes set forth above. According to the present invention, a three or more ply form is provided having a bottom ply with a first width and length, and with a self-contained self-imaging spot formed on the top surface of the bottom ply. The self-imaging spot covers only a small percentage of the area of the top surface. An insert ply, having a second width and length, both smaller than the first length and width, is provided, as is a top ply having essentially the first width and length, and means (e.g. adhesive) for operatively connecting the top ply to the bottom ply along both lengthwise and widthwise edges thereof. All plies are typically quadrate in configuration. Also means—typically adhesive—are provided for attaching the insert ply to the bottom and top plies along only a first lengthwise edge and along only a first widthwise edge, so that a second lengthwise and a second widthwise edge of the insert ply are free of connection to both the top and bottom plies. Perforations are formed in the insert ply parallel to the first lengthwise and widthwise edges thereof, to allow detachment of a detachable insert ply from the first lengthwise and widthwise edges thereof. The self-contained spot is disposed on the bottom ply underlying the area between the perforation parallel to the first lengthwise edge and the first lengthwise edge of the insert ply.

With the construction as described above, the detachable portion may comprise a check, and since there is no imaging requirement for the check itself, or for the stub portion thereof between the lengthwise perforation and the first lengthwise edge, the check may be made from regular paper instead of MCP paper—that is the check may be made from paper selected from the group comprising or consisting essentially of MICR bond, index, regular bond, and OCR bond. At the lengthwise edge of the top and bottom plies adjacent the second lengthwise edge of the check, there are thus only two plies which are adhesively connected together, and due to a perforation adjacent the second lengthwise edge of the check, the mailer may be readily opened. The top and bottom plies preferably are integral—or formed with a perforation—adjacent the second widthwise edge of the insert ply.

According to another aspect of the present invention a business form is provided comprising: a bottom ply having a first width and length; an insert ply having a second width and length, both smaller than the first length and width; a top ply having essentially the first width and length, and means for operatively connecting the top ply to the bottom ply along both lengthwise and widthwise edges thereof; means for attaching the insert ply to the bottom and top plies along only a first lengthwise edge and along only a first widthwise edge, so that a second lengthwise and second widthwise edge of the insert ply are free of connection to both the top and bottom plies; and means defining perforations in the insert ply parallel to the first lengthwise and widthwise edges thereof, to allow detachment of a detachable portion of the insert ply from the first lengthwise and widthwise edges thereof, the detachable portion comprising a check.

According to yet another aspect of the present invention, a business form is provided comprising a bottom ply having a first width and length, and having a self-contained self-imaging spot formed on the top surface thereof, the spot covering only a small percentage of the area of the top surface; an insert ply overlying the top surface of the bottom ply, including the self-imaging spot thereof; a top ply having essentially the first width and length, and means for operatively connecting the top ply to the bottom ply along both lengthwise and widthwise edges thereof; means for operatively attaching the insert ply to the bottom and top plies; means defining perforations in the insert ply parallel to edges thereof, to allow detachment of a detachable portion of the insert ply from the top and bottom plies; and the self-imaging spot on the bottom ply disposed underlying that portion of the insert ply between the detachable portion of the insert ply and an edge thereof.

It is the primary object of the present invention to provide and advantageous business form. This and other objects of the invention will become clear from an inspection of the detailed description of the invention, and from the appended claims.

DETAILED DESCRIPTION OF THE DRAWINGS

Figure 1:
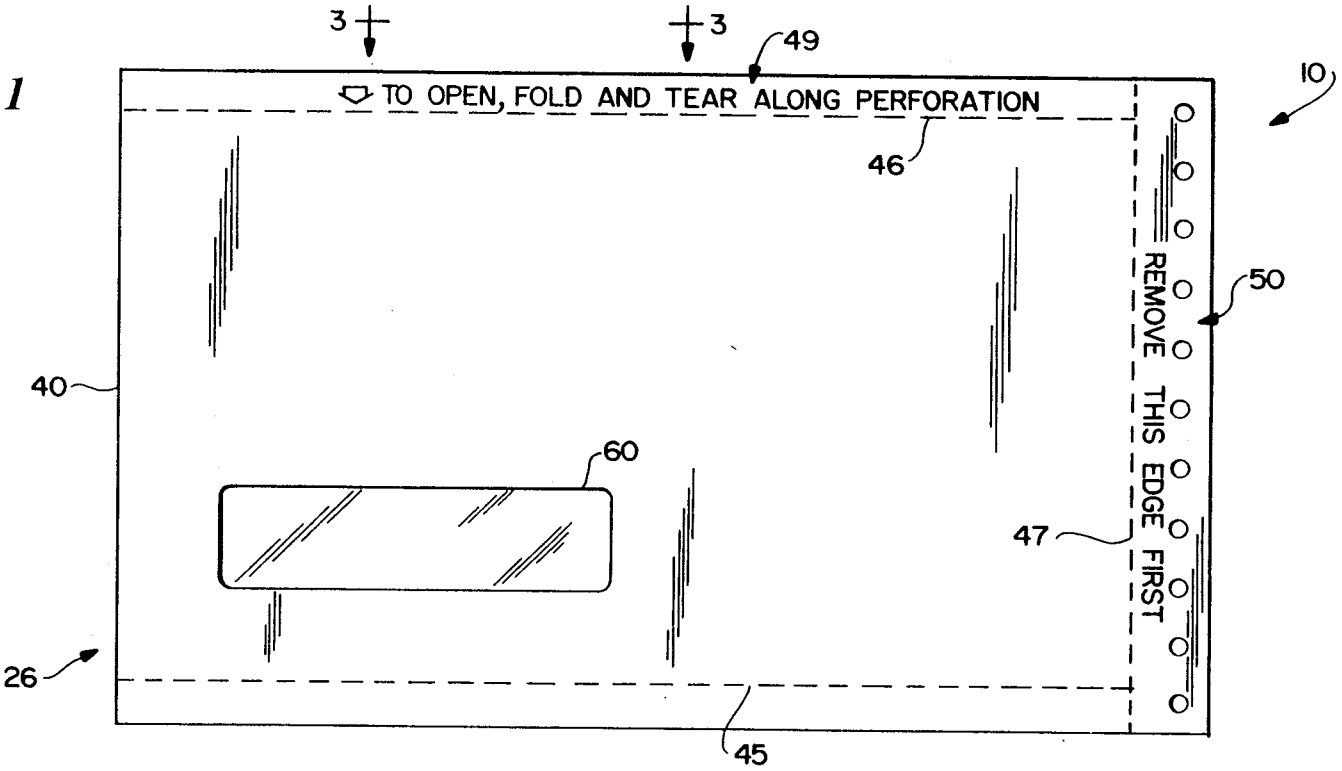
FIG. 1 is a top plan view of an exemplary form according to the present invention.
Figure 3:
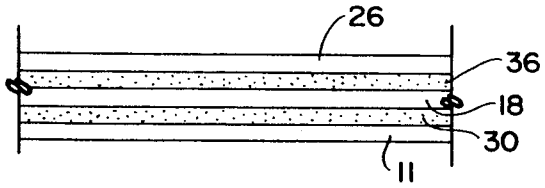
FIG. 3 is a cross-sectional view taken at line 3—3 of FIG. 1.

An exemplary business form according to the present invention is shown generally by reference 10 in the drawings. The form is commonly what is referred to as a mailer type business form, and intended to be sent through the mails to a customer or a user who will open the form. According to the present invention it is highly desirable to preserve the interior contents (insert) of the form intact since it is preferred that the interior comprise a check.

In the preferred construction, the form has three quadrate plies, although other insert plies may be provided if desired. One of the plies comprises a bottom ply 11, shown most clearly in FIGS. 4 and 5, and having a first width 12, and a first length 13. In the preferred embodiment, a self-contained, self-imaging spot 14 is formed on the top surface 15 of the bottom ply 11, opposite the bottom surface 16 (see FIG. 5) thereof. It is preferred that the self-imaging spot 14 be provided by coating the entire top surface 15 of the bottom ply 11 with CF material (i.e. the surface 15 is a full coated MCP/CF paper), while at the spot 14 itself a CB spot coating is provided.

Figure 2:
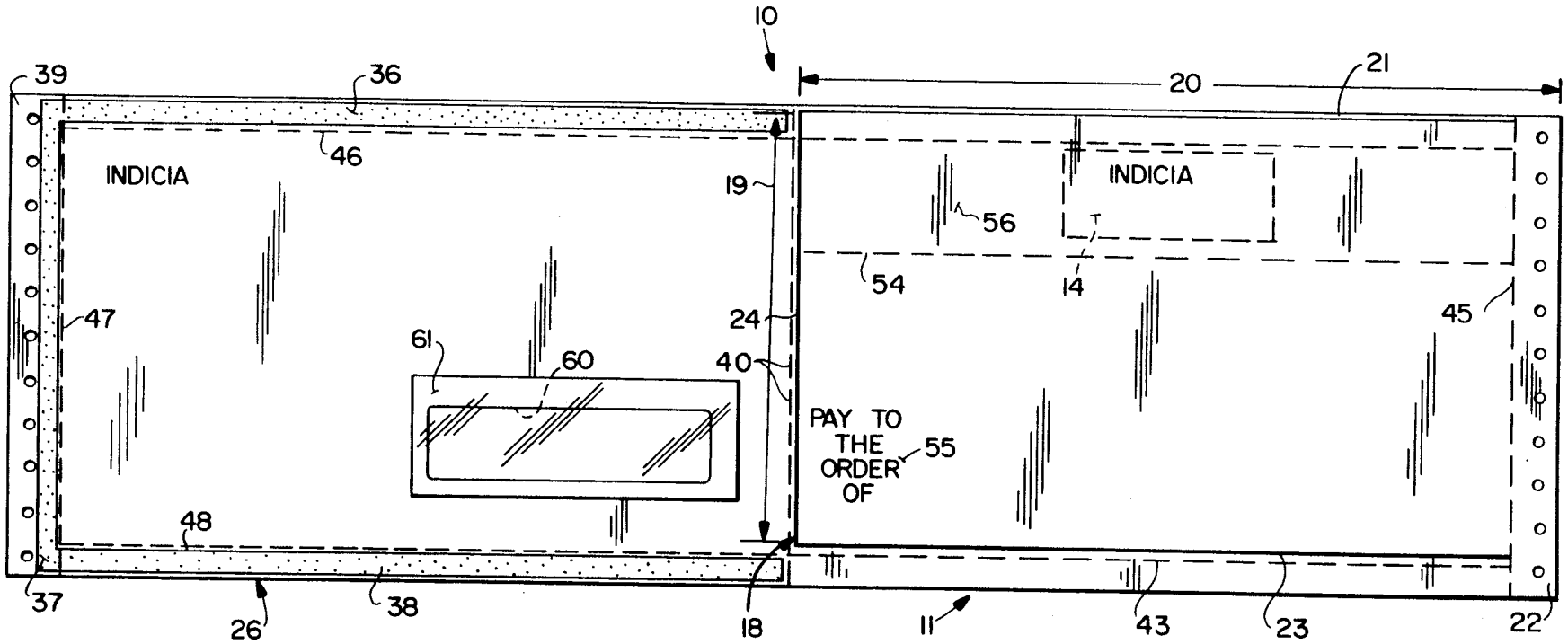
FIG. 2 is a plan view of the form of FIG. 1 opened up, before sealing of the top part of the form to the other parts thereof.
Figure 4:
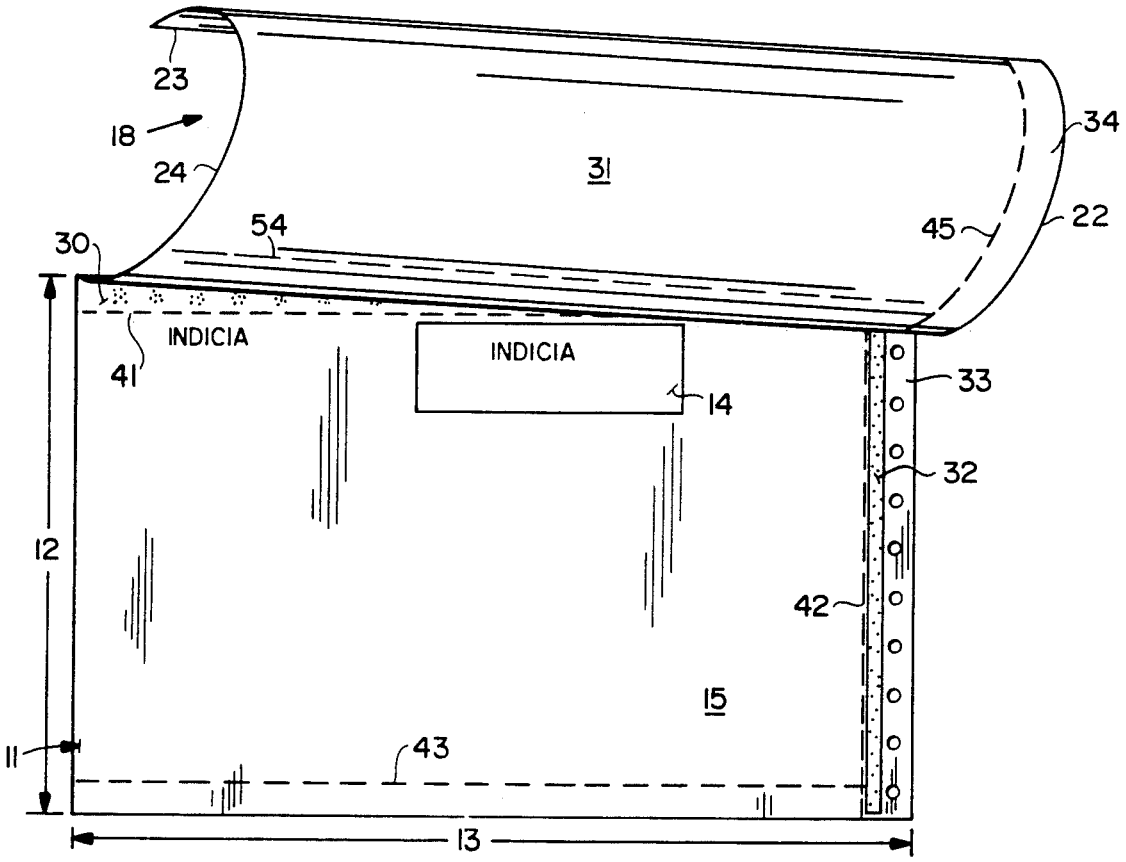
FIG. 4 is a top plan view of the bottom ply showing the insert ply peeled away therefrom.

Another ply of the form 10 comprises an insert ply 18, seen most clearly in FIGS. 2 and 4. The insert ply 18 has a second width 19 (see FIG. 2) and length 20 which is less than the width and length 12, 13, respectively. Preferably the insert ply 18 is provided by die cutting at the top (e.g. 1/16 inch) and bottom (e.g. 9/16 inch) a sheet which starts with a width 12. It has a first lengthwise edge 21—the top edge as viewed in FIG. 2—which is connected by connecting means to the bottom ply 11, and a first widthwise edge 22 which is likewise connected to the bottom ply 11. However, the second lengthwise edge 23 and the widthwise edge 24 of the quadrate ply 11 are free—being unconnected to either the bottom ply 11 or the top ply 26 (see FIGS. 1 and 2 in particular).

Figure 5:
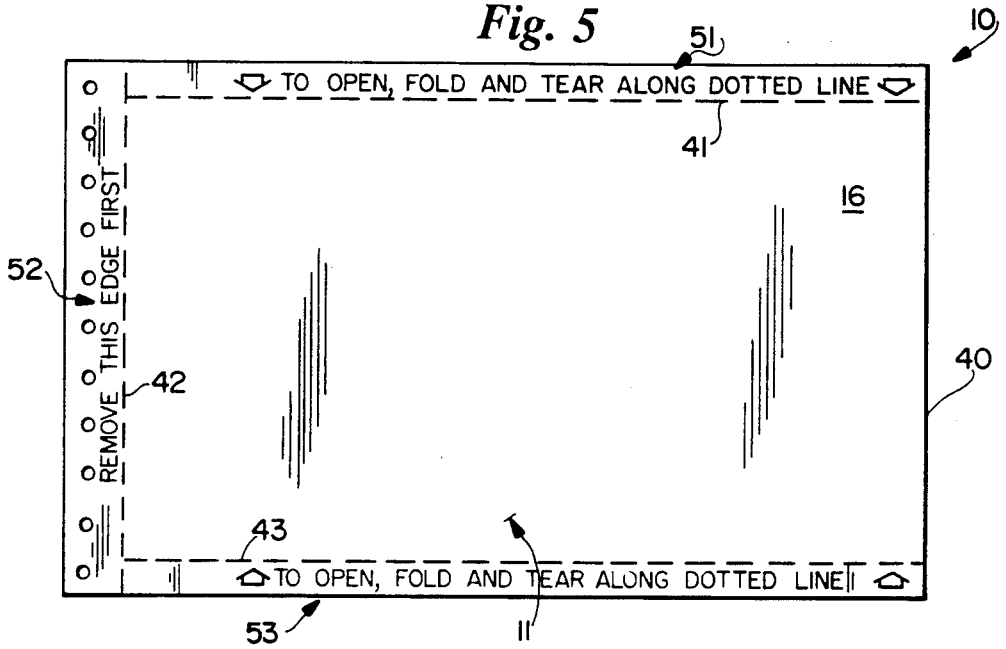
FIG. 5 is a bottom plan view of the form of FIG. 1.

As seen in FIGS. 1, 2, and 5, the top ply 26 preferably has essentially the same width and length dimensions as the bottom ply 11. When the form 10 is completely constructed, the top ply 26 is operatively connected (either directly or through the insert ply 18) with the bottom ply 11 at all four edges thereof.

The preferred connecting means for connecting the components 11, 18, and 26 together comprises an adhesive strip 30 at the first lengthwise edge 21 of the insert ply 18 formed on the bottom face 31 of the insert ply 18 and/or on the top face 15 of the bottom ply 11 (see FIG. 4), and an adhesive strip 32 formed adjacent the first widthwise edge 22 of the insert ply 18, preferably on top surface 15 of the bottom ply 11. The narrow strips 30, 32 are of conventional adhesive (e.g. heat sealable or pressure sealable) and directly connect the plies 11, 18 together. Note that the strip 32 may be disposed just inside the tractor feed hole portion 33 of the bottom ply 11, and on the most inward area of the tractor feed hole 34 of the insert ply 18.

The other ply interconnecting components are illustrated most clearly in FIG. 2. These include the adhesive strips 36, 37, and 38 which are formed along the top, the bottom, and left side edges of the inside face of the top ply 26 as seen in FIGURE 2. The narrow strip 36 is approximately coextensive with the strip 30, and connects the top ply 26 to the bottom ply 11 through the insert ply 18. The left side strip 37 is just inside the tractor feed portion 39 of the top ply 26, and connects the top ply 26 to the bottom ply 11 through the insert ply 18 adjacent the edge 22. The strip 38 connects the top ply 26 and bottom ply 11 together directly along the bottom edges thereof, in view of the fact that the second, bottom, edge 23 of the insert ply 18 terminates short of the strip 38. At the fourth edge of the plies 11, 26, they may also be connected by an adhesive strip, but in the preferred embodiment illustrated in the drawings they are integral, and the edge configuration thereof is provided by the perforations 40.

In order to allow ready opening of the mailer, perforations (or the equivalent) are provided inside of each of the adhesive strips 30, 32, and 36 through 38. For example, the perforation 41 is provided in the bottom ply 11 just inside of adhesive strip 30, and the perforation 42 is provided just inside of adhesive strip 32. Perforation 43 is just inside the adhesive strip 38 (when sealed to the bottom ply 11). In the insert ply 18, perforation 44 is in alignment with the perforation 41, and perforation 45 is in alignment with the perforation 42. In top ply 26, perforation 46 is in alignment with the perforations 41, 44, perforation 47 is in alignment with the perforations 42, 45, and perforation 48 is in alignment with the perforation 43. As indicated by the instructions 49, 50, 51, 52, and 53 on the top and bottom plies 26, 11, respectively (see FIGS. 1 and 5), the mailer is opened by detachment along the perforations 41 through 48. Because there are only two plies (11, 26) at the bottom of the form 10 as viewed in the drawings, the form is easy to seal and to tear open.

According to the preferred embodiment of the invention, the insert ply 18 includes a detachable portion, formed by the perforation 45 which is parallel to the edge 22, and the perforation 54 which is parallel to the edge 21. The detachable portion also is defined by the edges 23, 24. The detachable portion preferably comprises a check 55, and because of the construction of the form 10 there is little chance of it being torn when the form 10 is being opened. Also, the insert ply 18 preferably comprises a check stub portion 56 which is defined between the perforations 44, 45, and 54, and the second widthwise edge 24. The self-imaging spot 14 is disposed beneath this stub portion 56, that is underlying the area between the perforations 44, 54.

Because of the provision of the self-imaging spot 14 on the bottom ply 11 top surface 15, the check 55 (the entire insert ply 18) may be made of regular paper rather than MCP paper. This is very advantageous for check construction. For example, the insert ply 18 can be made of regular MICR bond, index, regular bond, or OCR bond. Also, any paper can be used for the bottom and top plies 11, 26 that can receive an MCP/CF coat and a spot CB coat Because of the particular die cut nature of the insert ply 18, there is also less tenting of the form and improved feed through the printer.

As indicated in the drawings, it is preferred that indicia be provided on all surfaces of all plies (except for the bottom surface 31 of the insert ply 18), and it is preferred that a die cut window 60 be provided in the top ply 26, which preferably is covered by a transparent strip 61 (see FIGS. 1 and 2).

In a conventional, exemplary, construction of the form 10, both surfaces of the combined bottom/top ply 11, 26 sheet are printed with non-variable information, and the insert ply 18—including the check portion 52 thereof—is likewise printed with non-variable information. Then the insert ply 18 is aligned with the bottom ply 11, and the adhesive strips 30, 32 activated, by pressure or heat sealing depending upon whether the adhesive is a pressure sensitive or heat activated adhesive. Then the form in the condition illustrated in FIG. 2 may be run through a printer to have the variable information printed thereon, such as the name and address of the check payee (which will ultimately appear through the window 60), withholding amounts, etc., which will appear on both the check 55 and the check stub 56, The information on the stub 56 will automatically transfer to the bottom ply 11 via the self-imaging spot 14. Then the top ply 26 is folded over the insert ply 18 and bottom ply 11, and the adhesive strips 36 through 38 activated by heat and/or pressure. The perforations 40–48, 54 may be provided at any suitable step in the processing.

It will thus be seen that according to the present invention an advantageous business form construction is provided, particularly for use as a mailer with a check.

While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent structures and products.

What is claimed is:

1. A business form comprising:

a bottom ply having a first width and length, and having a self-contained, self-imaging spot formed on the top surface thereof, said spot covering only a small percentage of the area of the top surface;

an insert ply having a second width and length, both smaller than said first length and width;

a top ply having essentially said first width and length, and means for operatively connecting said top ply to said bottom ply along both lengthwise and widthwise edges thereof means for attaching said insert ply to said bottom and top plies adjacent only a first lengthwise edge and along only a first widthwise edge, so that a second lengthwise and a second widthwise edge of said insert ply are free of connection to both said top and bottom plies; and means defining perforations in said insert ply parallel to said first lengthwise and widthwise edges thereof, to allow detachment of a detachable portion of said insert ply from the first lengthwise and widthwise edges thereof.

2. A business form as recited in claim 1 wherein said self contained spot is disposed on said bottom ply underlying the area between said perforation parallel to said first lengthwise edge and said first lengthwise edge of said insert ply.

3. A business form as recited in claim 2 wherein insert ply detachable portion comprises a check.

4. A business form as recited in claim 3 wherein said check is made of paper selected from the group consisting essentially of MICR bond, index, regular bond, and OCR bond.

5. A business form as recited in claim 4 wherein said means for connecting said first lengthwise and widthwise edges of said insert ply to said top and bottom plies comprises adhesive strips.

6. A business form as recited in claim 5 wherein said means for operatively connecting said top and bottom plies to each other comprise adhesive strips adjacent said first lengthwise and widthwise edges connecting both said top and bottom plies to said insert ply, and an adhesive strip directly connecting said top and bottom plies together adjacent, but spaced from, said second lengthwise edge.

7. A business form as recited in claim 6 wherein said top and bottom plies are integral with each other at an edge opposite said first widthwise edge.

8. A business form as recited in claim 7 further comprising a perforation at the integral edge of said top and bottom plies.

9. A business form as recited in claim 2 wherein said top ply has a window therein overlying a portion of said insert ply.

10. A business form as recited in claim 5 wherein said self contained spot underlies that portion of said insert ply that is between said adhesive strip adjacent said first lengthwise edge, and said perforation parallel to said first lengthwise edge.

11. A business form as recited in claim 1 wherein said bottom ply top surface comprises full coated MCP/CF paper having a CB spot applied just at said self-imaging area.

12. A business form as recited in claim 1 further comprising perforations formed in said top and bottom plies adjacent said second lengthwise edge of said insert ply.

13. A business form comprising:

a bottom ply having a first width and length;

an insert and length, both smaller than said first length and width;

a top ply having essentially said first width and length, and means for operatively connecting said top ply to said bottom ply along both lengthwise and widthwise edges thereof;

means for attaching said insert ply to said bottom and top plies adjacent only a first lengthwise edge and along only a first widthwise edge, so that a second lengthwise and second widthwise edge of said insert ply are free of connection to both said top and bottom plies; and means defining perforations in said insert ply parallel to said first lengthwise and widthwise edges thereof, to allow detachment of a detachable portion of said insert ply from the first lengthwise and widthwise edges thereof, said detachable portion comprising a check.

14. A business form as recited in claim 13 wherein said check is made of paper selected from the group consisting essentially of MICR bond, index, regular bond, and OCR bond.

15. A business form as recited in claim 14 wherein said means for connecting said first lengthwise and widthwise edges of said insert ply to said top and bottom plies comprises adhesive strips.

16. A business form as recited in claim 15 wherein said means for operatively connecting said top and bottom plies to each other comprises adhesive strips adjacent said first lengthwise and widthwise edges connecting both said top and bottom plies to said insert ply, and an adhesive strip directly connecting said top and bottom plies together adjacent, but spaced from, said second lengthwise edge.

17. A business form as recited in claim 16 wherein said top and bottom plies are integral with each other at an edge opposite said first widthwise edge.

18. A business form as recited in claim 17 further comprising a perforation at the integral edge of said top and bottom plies.

19. A business form as recited in claim 14 wherein said top ply has a window therein overlying a portion of said insert ply.

20. A business form as recited in claim 13 wherein the portion of said insert ply between said detachable portion and said first lengthwise edge thereof comprises a check stub portion.

21. A business form comprising:

a bottom ply having a first width and length, and having a self-contained self-imaging spot formed on the top surface thereof, said spot covering only a small percentage of the area of the top surface;

an insert ply overlying the top surface of said bottom ply, including said self-imaging spot thereof;

a top ply having essentially said first width and length, and means for operatively connecting said top ply to said bottom ply adjacent both lengthwise and widthwise edges thereof;

means for operatively attaching said insert ply to said bottom and top plies;

means defining perforations in said insert ply parallel to edges thereof, to allow detachment of a detachable portion of said insert ply from the top and bottom plies; and said self-imaging spot on said bottom ply disposed underlying that portion of said insert ply between said detachable portion of said insert ply and an edge thereof.

22. A business form as recited in claim 21 wherein insert ply detachable portion comprises a check made of paper selected from the group consisting essentially of MICR bond, index, regular bond, and OCR bond.

* * * * *